United States Patent [19]

Pierce

[11] 4,051,670

[45] Oct. 4, 1977

[54] SUCTION VENT AT RECIRCULATION ZONE OF COMBUSTOR

[75] Inventor: Robert M. Pierce, Tequesta, Fla.

[73] Assignee: United Technologies Corporation, Hartford, Conn.

[21] Appl. No.: 582,538

[22] Filed: May 30, 1975

[51] Int. Cl.[2] ..... F02K 3/00; F02K 3/10

[52] U.S. Cl. ..... 60/39.72 R; 60/39.74 R; 60/261

[58] Field of Search ..... 60/39.72 R, 39.74 R, 60/39.74 B, 261, 39.69, 39.52; 431/115, 116

[56] References Cited

U.S. PATENT DOCUMENTS

| | | | |
|---|---|---|---|
| 2,224,544 | 12/1940 | Keller | 431/115 X |
| 2,517,399 | 8/1950 | McCollum | 431/116 X |
| 2,799,991 | 7/1957 | Conrad | 60/39.74 R |
| 2,941,361 | 6/1960 | Spalding | 60/39.72 R |
| 3,439,496 | 4/1969 | Beuers | 60/39.16 R |
| 3,618,318 | 11/1971 | Bryce | 60/39.72 |
| 3,631,675 | 1/1972 | Keiter et al. | 60/39.23 |
| 3,817,690 | 6/1974 | Bryce et al. | 60/39.72 |
| 3,910,035 | 10/1975 | Juhasz et al. | 60/39.74 R |
| 3,927,958 | 12/1975 | Quinn | 60/39.52 |

*Primary Examiner*—Carlton R. Croyle
*Assistant Examiner*—Thomas I. Ross
*Attorney, Agent, or Firm*—Jack N. McCarthy

[57] ABSTRACT

A centrally disposed vent is positioned adjacent the low pressure region of recirculating gases in a combustor or augmentor of the type used in gas turbine engines, allowing gas to be abstracted from the core of the recirculating region, thereby causing a reduction in static pressure, and a strengthening and stabilizing of the recirculating flow pattern. Combustion occurring in the recirculating gas is intensified by virtue of higher mixing rates, and flame stability is enhanced by virtue of increased stability of the recirculating flow pattern. The vent is shown employed in a premixing tube device for use in gas turbine engine main combustors. Alternative main combustor and augmentor combustor configurations are shown.

9 Claims, 7 Drawing Figures

SUCTION VENT AT RECIRCULATION ZONE OF COMBUSTOR

The invention herein described was made in the course of or under a contract or subcontract with the Department of the Air Force.

BACKGROUND OF THE INVENTION

Previous known attempts to intensify recirculation zone strengths have involved refinements in the designs of swirl vane assemblies including vane angles, vane contours, number of vanes and degree of central blockage and modifications to the surrounding walls of the recirculation section of the burner.

SUMMARY OF THE INVENTION

In accordance with the present invention means are provided to strengthen and stabilize the recirculating flow of aerodynamic recirculation in burners. In each case the strength and stability of the recirculating flow is enhanced by a further reduction in static pressure within the recirculation zone. Such a reduction is brought about by venting gases through appropriate openings and conduits from within the recirculation zone to ambient surroundings outside the engine, or other sections of the engine that operate at lower pressures than the combustor compartment.

Various methods of setting up aerodynamic recirculation for the purpose of flame stabilization are used in gas turbine engines. The most common of these are swirler-induced recirculation (usually encountered in primary combustors) and bluff-body recirculation (usually encountered in augmentors). In these and other examples, a region of low pressure exists within the recirculation zone, promoting reverse flow.

Combustion processes occuring in aerodynamic recirculation zones are affected beneficially by the appropriate venting of gases from within the zones. First, a net increase in the rate of circulation of gases within the recirculation zone occurs, causing greater turbulent mixing, and a resultant increase in combustion intensity. Second, the integrity and stability of the recirculation zone is reenforced (reverse flow can be established and maintained under conditions ordinarily marginal for recirculation), and as a result, flame can be stabilized over a broader range of operating conditions. By virtue of these factors improved ignition, blowout and relight performance is attained for gas turbine applications.

It is a further object of this invention to provide a control for reducing the pressure within a recirculating zone to achieve the desired amount of vent flow. Too much venting can cause the recirculating zone to collapse.

It is a further object of this invention to provide a plurality of premixing tubes around an annular burner with each premixing tube having a centerbody at the outlet thereof supported by swirl vanes and having a vent conduit in the center thereof.

It is a further object of this invention to redirect the vented gas through a burner to complete burning thereof allowing the chemical energy contained in any unreacted constituents to be recovered. This burner can be an auxiliary burner, main burner, or afterburner.

It is a further object of this invention to physically remove offending species from the flame in a burner. The species could contain amount of $NO_x$, CO and unburned hydrocarbons (UHC). In a test burner run, a troublesome region of partially reacted constituents was substantially eliminated in the burner by the use of a vent probe adjacent the recirculating zone.

Another object of this invention is to provide a cooled vent probe if it is neccessary to have a probe extend into the burner means.

DESCRIPTION OF THE PREFERRED EMBODIMENT

Figure 1:
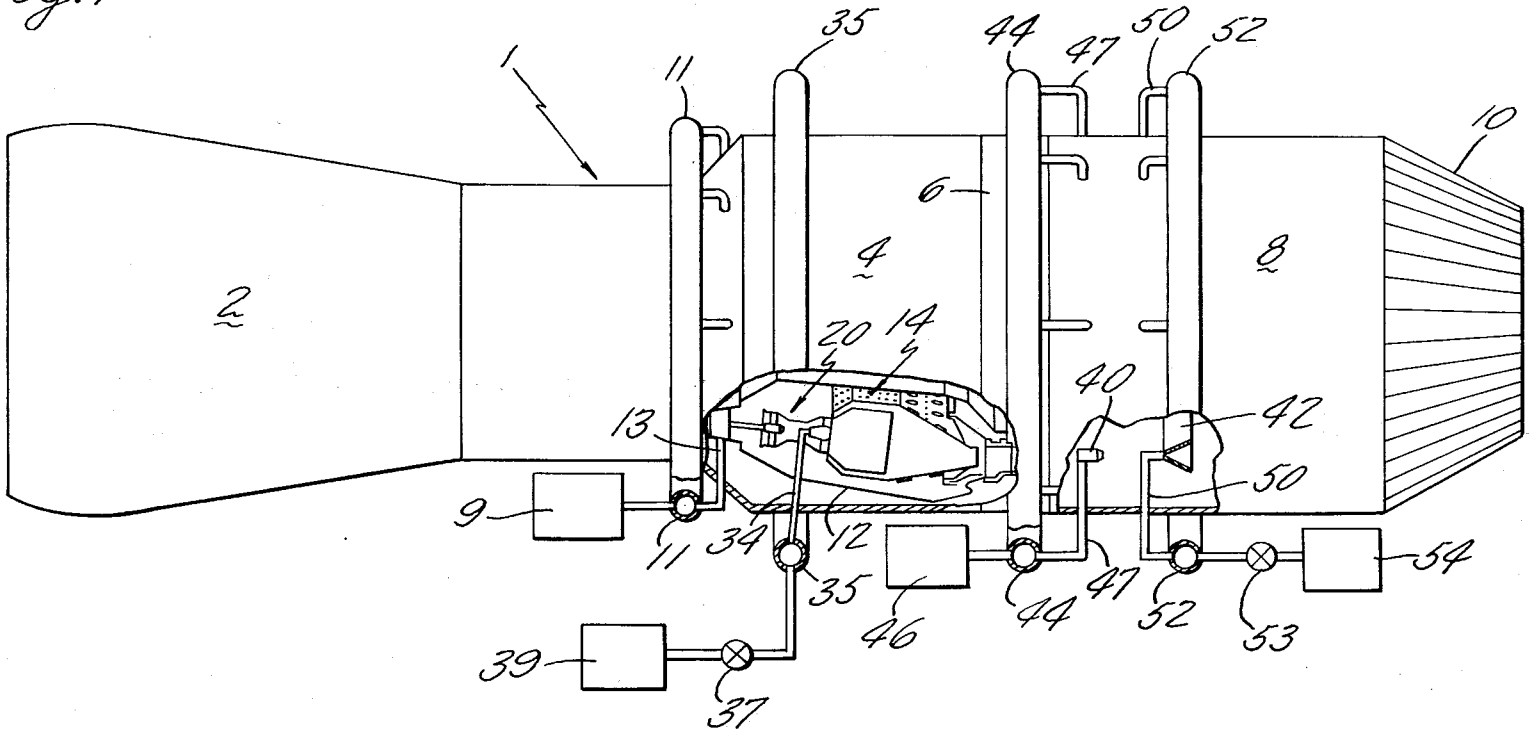
FIG. 1 is a view of a gas turbine engine having an afterburner showing the location of the main burner means in the engine and the location of the fuel injection means and flameholder in the afterburner.

Referring to FIG. 1 a gas turbine powerplant including a turbine engine and afterburner is shown indicated generally by 1. The powerplant has a compressor section 2, combustion section 4, a turbine section 6, an afterburner section 8, and a nozzle 10. The combustion section 4 is comprised of an annular burner casing 12 with an annular burner 14 therein. A conventional fuel supply and metering control 9 provides the desired fuel flow to an annular manifold 11. A conduit 13 extends from the annular manifold 11 to each one of a plurality of premixing tubes 20. These premixing tubes 20 are fixed to and project forwardly from the forward end of the annular burner 14 for delivering compressor airflow and fuel into the annular burner 14 at A. A staged premixing tube is shown in U.S. application Ser. No. 501,739, now U.S. Pat. No. 3,905,192, in which the tube is movable between two positions.

Each premixing tube 20 includes a fuel nozzle 22 located at the forward end in an airflow inlet section 24, and a premixing passage 25 connecting the inlet section to an annular outlet section 26. A centerbody 28 is supported in the center of the outlet section 26 by swirl vanes 30 forming an annular passage. The centerbody 28 provides a reasonably constant area transistion from the cylindrical premixing passage 25 to the annular outlet section 26, this centerbody also increases the swirler recirculation zone strength. The fuel nozzle 22 can be of any type providing fine atomization of the fuel and even distribution thereof over the cross section of the premixing passage 25.

The airflow inlet section 24 is circular with a venturi-type inlet and the forward part of the premixing passage 25 is contoured to provide a low pressure drop and an even distribution of the airflow flowing through the premixing passage 25. Airflow is forced through the premixing tube by the differential pressure across the annular burner 14. This can also be done by an external high pressure supply.

Fuel is introduced through each fuel nozzle 22, from a conduit 13, into the premixing passages 25 where intimate mixing of the fuel and air takes place. Each fuel nozzle 22 is supported in the inlet section by struts 29. The fuel-air mixture is discharged into the annular burner 14 at A through the swirl vanes 30 forming a recirculation zone B. While one means of directing a fuel-air mixture into the annular burner 14 is described wherein a recirculation zone is swirler induced, other devices can also be used and recirculation can be formed by a bluff body alone (see FIG. 3) or by an internal flow directed pattern, (see FIG. 7) for example.

The swirl vanes 30 of each premixing tube 20 impart swirl to the fuel-air mixture discharging from the premixing tube at A, establishing a region of swirling flow inside the combustor and a central region or Zone B, of recirculating gas flow. Flame is stabilized by the reverse flow of burning gases in the central region, or Zone B, and a subsequent entrainment by the surrounding swirling flow. The annular burner 14 has an impingement cooled forward section with air being also directed into the burner at the downstream end at holes 15.

A central vent passage 32 is located in the centerbody 28 through which a portion of the gases can be abstracted and removed from the interior of the annular burner 14 within the recirculating gas flow. A vent tube 34 is connected between the forward end of each vent passage 32 with its other end being connected to a manifold 35. Manifold 35 is connected through a valve means 37 to a chamber 39 or other area where the pressure is lower than that in the annular burner 14. A chamber 39 can have a pump for controlling its pressure therein. Valve means 37 can be controlled to vary the quantity of gas flow abstracted to achieve a desired burning pattern within the annular burner 14. When the valve means 37 is placed in an off position, the vent tubes 34 will not abstract any flow and a conventional pattern of recirculating flow will be established. While the vent passages 32 are all shown connected to one manifold 35, they can each be connected to a separate control if desired.

As the valve means 37 is opened, gases are forced into the vent passage 32 and driven through the vent tube 34 of each premixing tube 20 by the differential pressure between the central zone B of recirculating gas flow and the environment in chamber 39 or other area where the tubes 34 have been selected to discharge. The removal of gases in this manner causes a reduction in static pressure in the central zone B of recirculating gas flow and a resultant increase in the amount of reverse gas flow entering the zone B as part of the recirculation pattern.

This increase in reverse flow enhances the strength and stability of the Zone B of recirculating gas flow and offending species can also be removed physically from the flame at the same time. The increase in reverse gas flow is beneficial to combustion in the following ways:

1. a portion of the increased quantity of reversed gas flow is not drawn into the vent passage 32 but is entrained by the swirling flow surrounding the central zone B of recirculating gas flow and as a result, the net rate of circulation of gases in the zone increases. This constitutes increase in turbulent mixing, which in turn causes more rapid combustion and makes the combustion zone more compact and the reaction more intense.
2. Increased recirculatory flow in the gases not abstracted through the vent passage 32 also makes a greater quantity of burning reactants available for continual ignition of the swirling fuel-air mixture entering the annular burner 14 through the swirl vanes 30. Improvements realized in this fundamental flameholding process help obtain ignition under conditions of marginal combustion (such as low pressure or reduced fuel-air equivalent ratio) and thereby prevent blow out of the flame and be an aid to ignition and relighting.
3. The withdrawal of gas flow through the centrally disposed vent passage 32 helps fix and maintain the portion of the recirculating flow zone at a desired location in the annular burner 14.
4. The gas flow abstracted through the vent passage 32 also helps establish and maintain recirculatory flow under conditions where it would not otherwise exist such as in the case of low swirl intensity and in the presence of disrupting aerodynamic disturbances from other sources in the annular burner 14.
5. The portion of gas flow through the centrally disposed vent passage 32 physically removes any offending species existing in that area at the time of removal.

Figure 3:
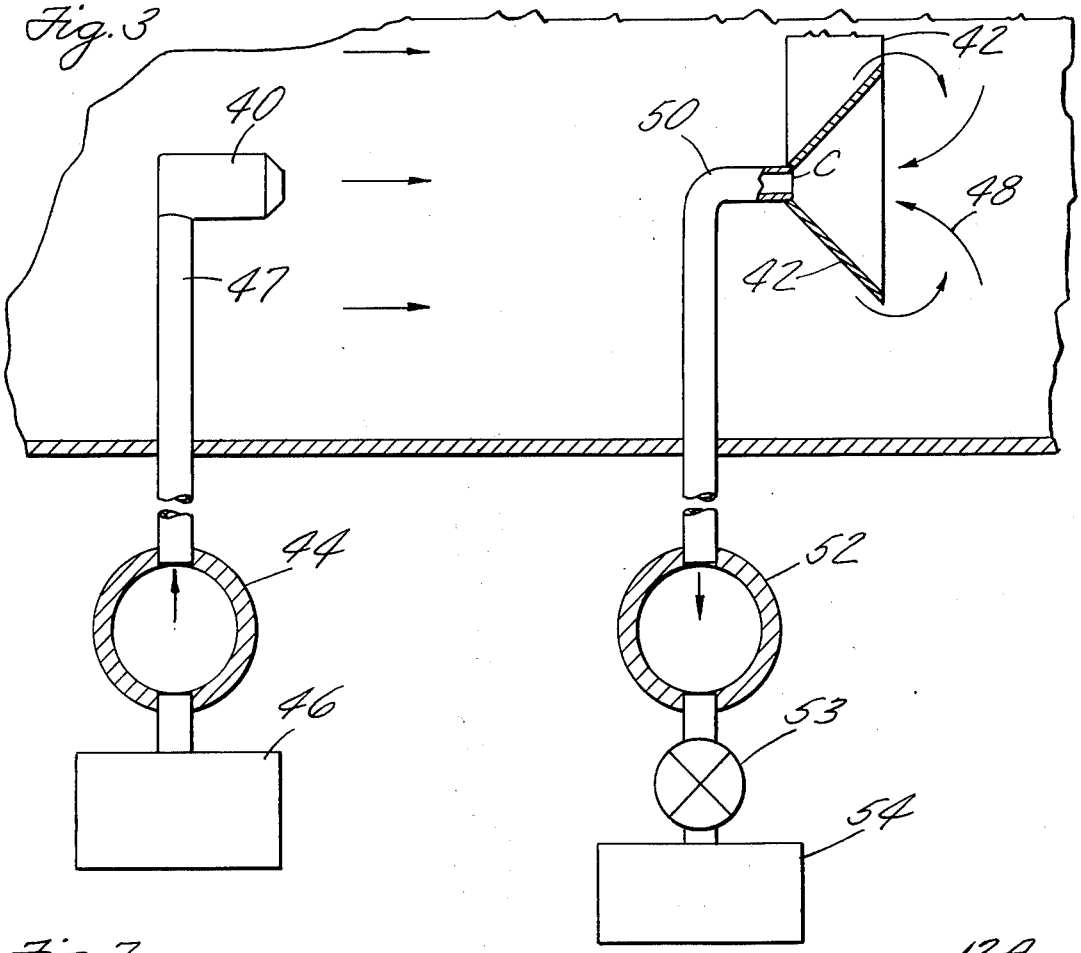
FIG. 3 is an enlarged sectional view of the fuel injection means and flameholder of FIG. 1 showing a vent means.

Referring to FIG. 3 a section of the afterburner is shown having a typical arrangement of fuel injection means 40 and a bluff body V-gutter, flameholder 42. As shown in FIG. 1 the desired fuel flow is provided to an annular manifold 44 by conventional afterburner fuel supply and metering control 46. A conduit 47 extends from the annular manifold 44 to each fuel injection means 40. Fuel is injected into the afterburner flow stream and carried downstream to the flameholder 42, as processes of atomization, vaporization, and dispersion of the fuel in the surrounding gases occur. A recirculation zone 48 is set up in the wake of flameholder 42 as the fuel-air mixture approaching from upstream passes over the body of the flameholder. Flame stabilization takes place as burning reactants are caught up in the reverse flow region and serve as a source of continued ignition to the fuel-air mixture flowing over the flameholder. A plurality of vent tubes 50 are provided with each free end C provided at a location adjacent to the recirculation zone 48 and each vent tube 50 is connected to a manifold 52 which is in turn connected through a valve means 53 to a chamber 54 of a low pressure environment. Pump means can also be used to arrive at a desired pressure in chamber 54. When the vent tubes 50 are closed by the valve means 53, no flow is abstracted through the vent tubes 50, and a conventional pattern of recirculating flow is established in the wake of the flameholder 42.

In a manner similar to the operation of the main combustion section 4, the opening of the valve means controlling flow in vent tubes 50 cause gases to be forced into the free end C of the vent tubes and driven therethrough by the conventional pressure between zone 48 and the remote external environment into which they are discharged. The removal of gases in this manner causes a reduction in static pressure in the recirculation zone 48 and a resultant increase in the amount of reverse gas flow entering the zone as part of the recirculation pattern. All of the benefits to combustion described for the main combustion section apply in full to the afterburner arrangement just described.

Figure 4:
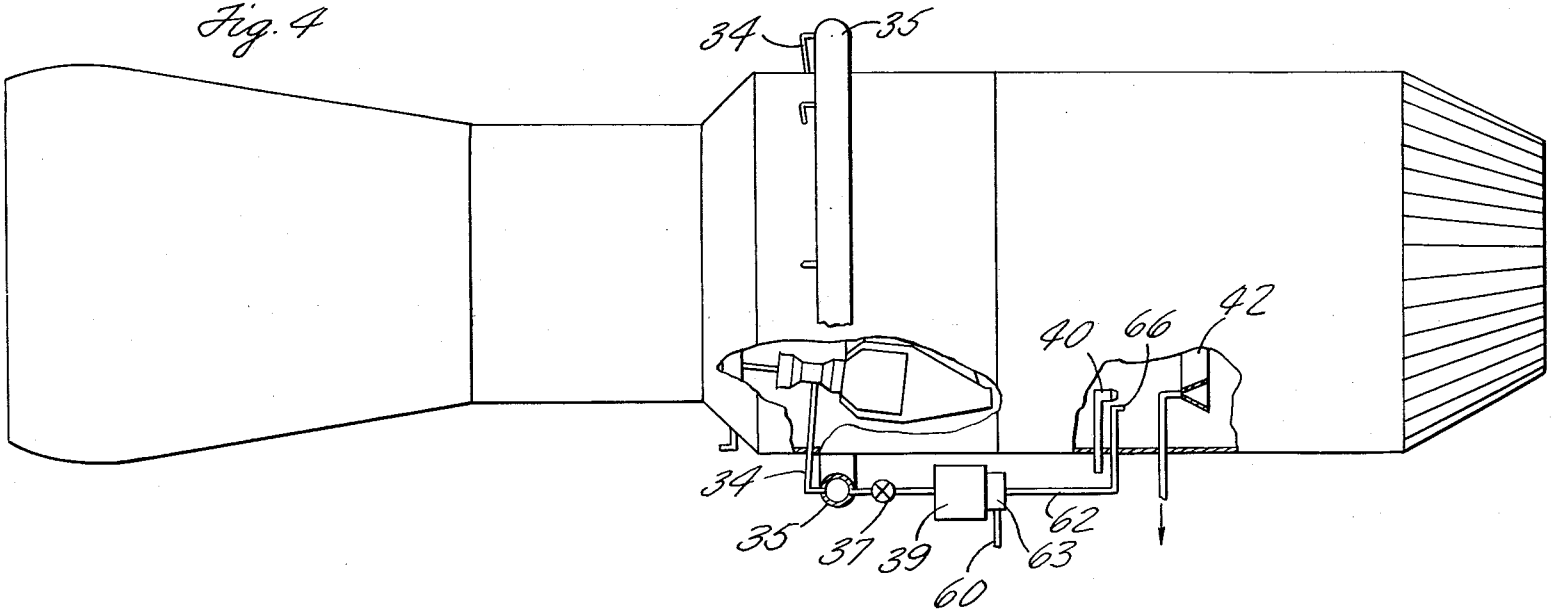
FIG. 4 is a modification of the arrangement shown in FIG. 1 including a vent and control means.

After gas flow has been abstracted from the interior of a burner within the recirculating gas flow and directed to a chamber 39, it may simply be dumped by a control means 63 to ambient surroundings through a conduit 60 or directed through a conduit 62 to a gaseous injector 66, which is located adjacent a fuel injection means 40 for burning therewith at flameholder 42 (see FIG. 4). While the procedure of simply dumping the abstracted gas flow to ambient surroundings entails the loss of unreacted constituents, with an inherent energy loss from the engine cycle, and the additional problem of environmental pollution, it may be a desirable expedient under transient engine operating conditions where, for example, increased recirculation zone strength can be instrumental in effecting ignition or preventing flameout. Under stable operating conditions, the problem of environmental pollution can be offset by passing the abstracted gas flow through a burner before being discharged to ambient surroundings. This may be done by transferring the abstracted gas flow to any other section of the engine operating at a lower pressure than the combustor compartment from which it is withdrawn and which is upstream of a combustion process. In particular, one location into which the abstracted gas flow could be injected is into the afterburner along with afterburner fuel as described above.

Figure 5:
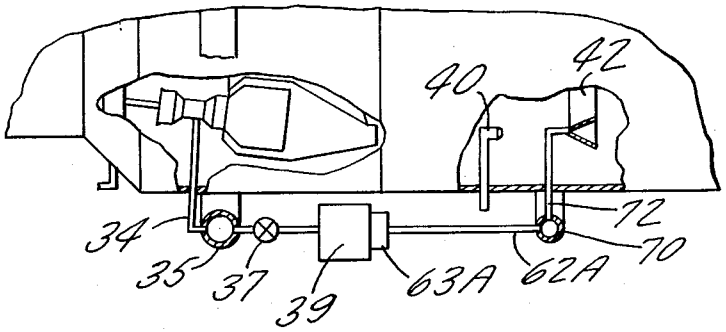
FIG. 5 is a fragmentary view of a portion of FIG. 4 showing another modification of a vent and control means.

A modification of the arrangement of handling the abstracted gas is shown in FIG. 5 where a control means 63A varies the quantity of gas flow as a function of engine power setting and ambient operating conditions and directs it through a conduit 62A to a manifold 70 where it is directed through individual conduits 72 a location at the forward end of the flameholders 42. This arrangement introduces the gas flow into the central low-pressure region of the recirculation zone. This arrangement allows the abstracted gas flow, which is typically rich in unburned partially reacted fuel to serve as a supplemental means of increasing the fuel-air ratio in the bluff body recirculation zone, thereby promoting combustion under more extreme operating conditions and expanding the operational limits of the afterburner.

Figure 6:
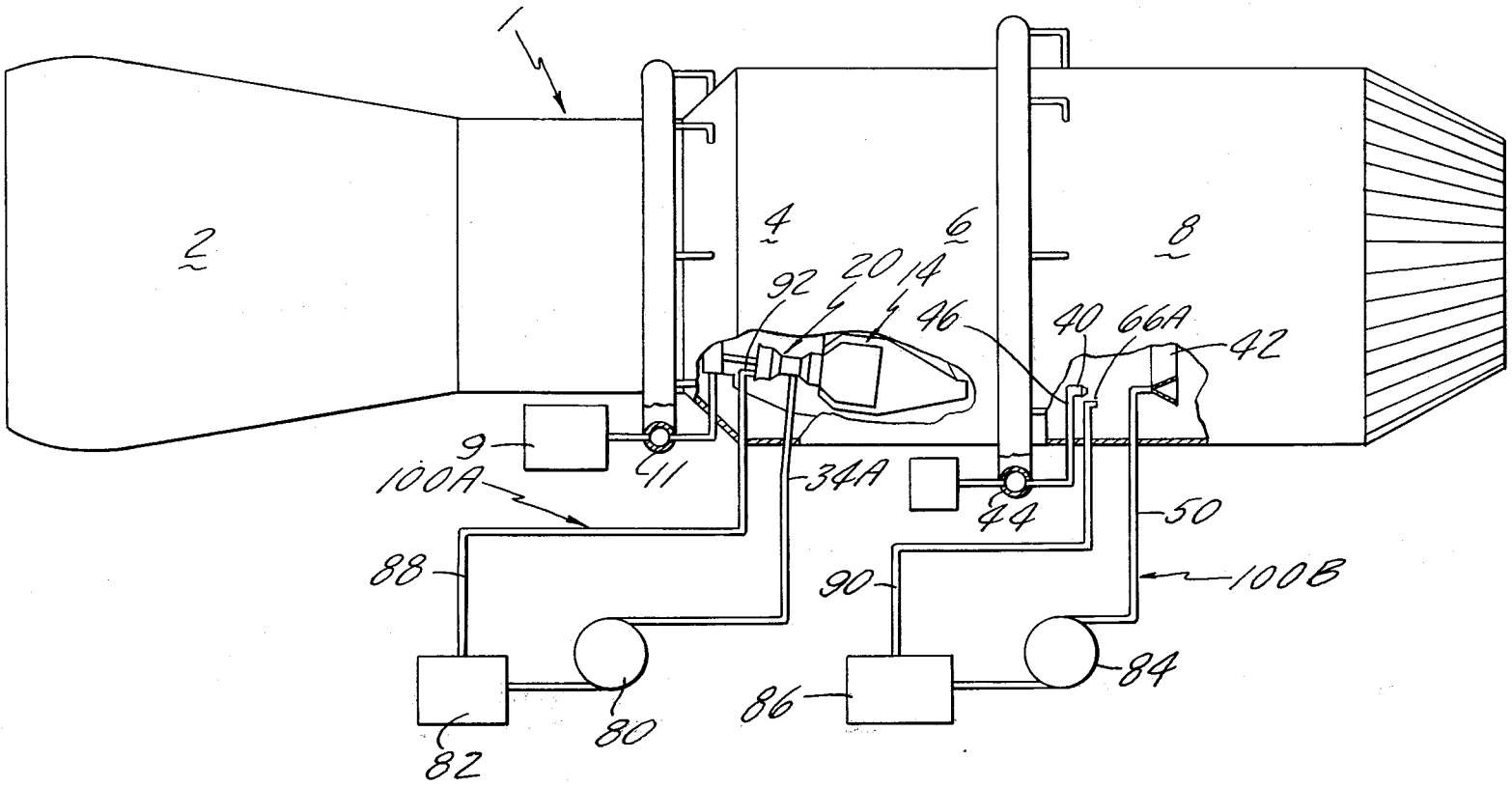
FIG. 6 is a view showing another modification of a of a vent and control means.

The modification shown in FIG. 6 shows a plurality of separate means 100A and 100B for abstracting gas flow from both the main burner means and afterburner and returning it, respectively, to the main burner means and afterburner. Each means 100A withdraws the gas from the main burner 14 by a vent tube or conduit 34A connected to the vent passage in the afterbody at the rear of its cooperating premixing tube 20 and returns it to the engine at the airflow inlet section 24 of the same tube 20. A pump 80 is provided in each conduit 34A with a valve means 82 located in series therewith. Each valve means 82 is connected by a conduit 88 to a gaseous injector directing flow into the cooperating tube 20. The pump 80 and valve means 82 provide the desired vent pressure while the valve means also provides "On"-"Off" capability.

Each means 100B is similar to the means 100A with the vent tube or conduit 50 being connected to the flameholder 42 as shown in FIG. 3, to withdraw gas from the afterburner, and return it to the afterburner at a point adjacent the fuel nozzle 40.

Figure 7:
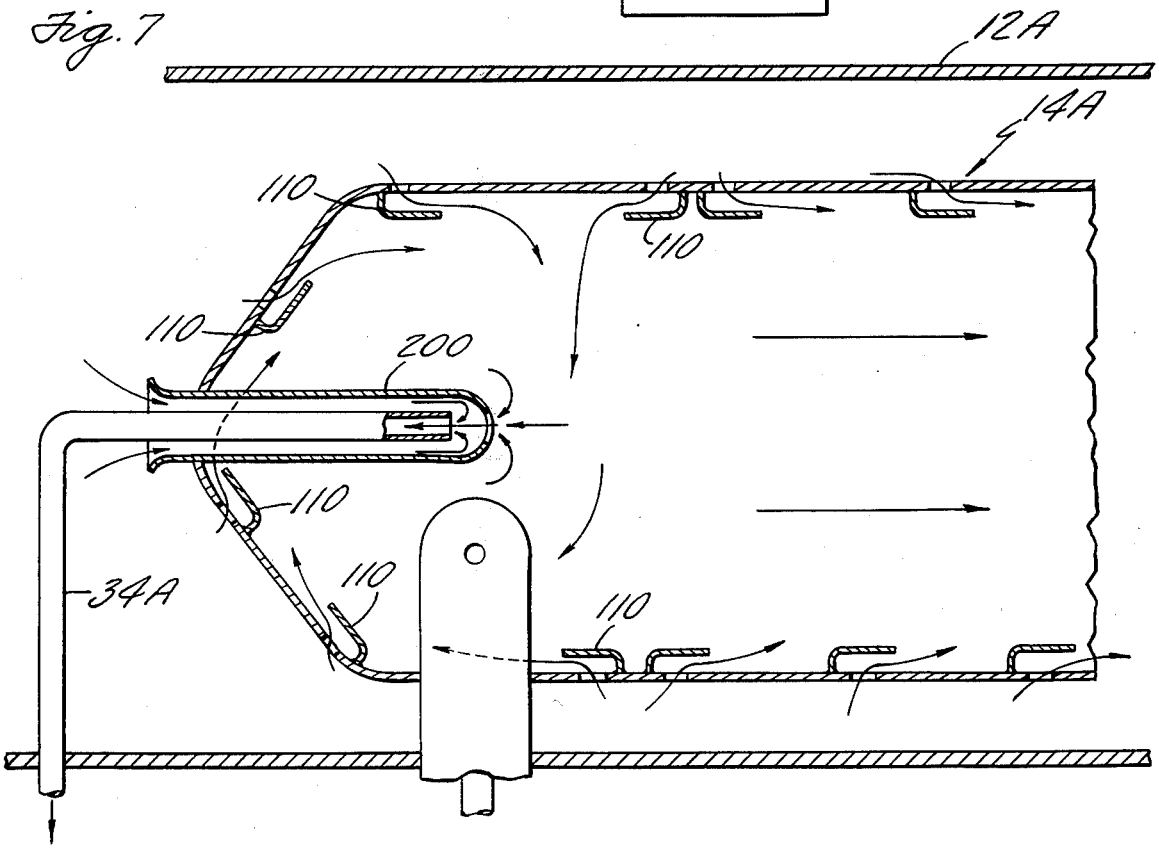
FIG. 7 shows another modification of a vent means on a main combustion chamber.

In the modification shown in FIG. 7 a recirculation zone is induced by the strategic placement of jets of air entering the burner means 14A, the jets of air being deflected by louvers 110. A probe 200 is used to withdraw gas at a point located rearwardly of the front of the burner 14A and within the boundry of the louvers 110. It is noted that the probe 200 is air cooled with the gas being withdrawn acting as an ejector to draw the air through the probe.

Figure 2:
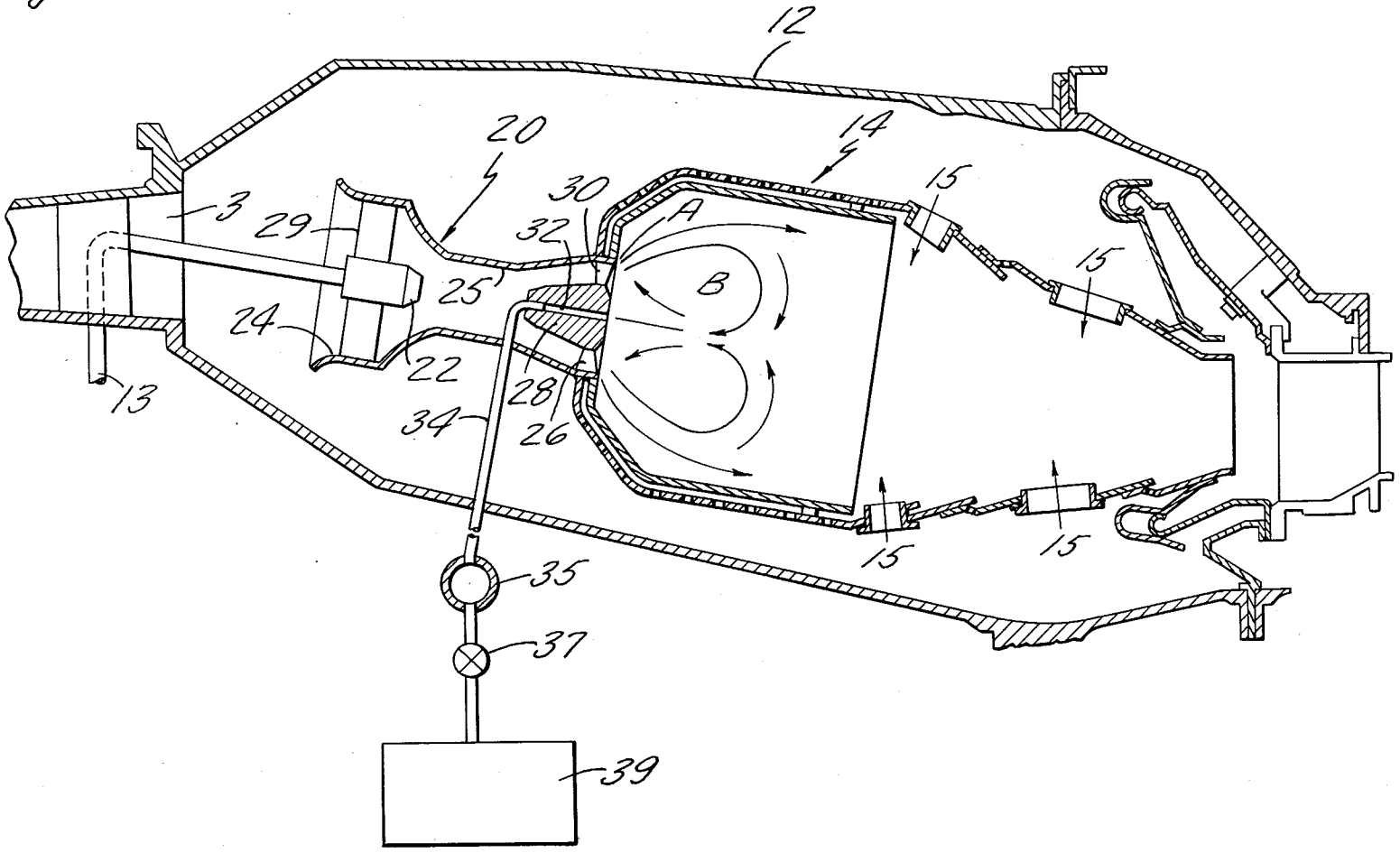
FIG. 2 is an enlarged sectional view of the main burner means of FIG. 1 showing the related structure and a vent means.

It is noted that the vent passage 32 of FIG. 2 can be formed with a projection similar to the probe 200, to withdraw gases nearer the center of the recirculating zone, if desired.

I claim:

1. In combination in a gas turbine engine, a combustion section including a burner means, means for forming a region of recirculating fuel/air mixture in said burner means having a flow pattern suitable for combustion, means for reducing the pressure within the recirculating region for strengthening and stabilizing the recirculating flow pattern, said pressure reducing means including a vent conduit means, said vent conduit means having one end located at the recirculating region and the other end connected to a region of lower pressure for removing flow from said recirculating region, said vent conduit including a probe which extends into the recirculating region to withdraw gases therefrom.

2. A combination as set forth in claim 1 wherein means are provided for cooling said probe.

3. A combination as set forth in claim 2 wherein said probe has a housing forming an annular passageway, said means for cooling said probe having means for flowing a cooling fluid through said annular passageway of said housing.

4. A combination as set forth in claim 3 wherein said probe has a second passageway for withdrawing gases from the recirculating region.

5. A combination as set forth in claim 1 wherein said probe extends into the recirculating region downstream of said means for forming a region of recirculating fuel/air mixture.

6. In combination in a gas turbine engine, a combustion section including a burner means, means for forming a region of recirculating fuel/air mixture in said burner means having a flow pattern suitable for combustion, said means for forming a region of recirculating fuel/air mixture including a first opening at the forward end of said burner means, a centerbody supported in said first opening forming an annular opening, said annular opening having means for swirling the flow entering the burner means, means for reducing the pressure within the recirculating region for strengthening and stabilizing the recirculating flow pattern, said pressure reducing means including a vent conduit means, said vent conduit means having one end located at the recirculating region and the other end connected to a region of lower pressure for removing flow from said recirculating region, said vent conduit means having its one end extending through said centerbody to a second opening at the center of the centerbody facing the region of recirculating fuel/air mixture.

7. A combination as set forth in claim 6 wherein a probe extends from said second opening into the recirculating region.

8. A combination as set forth in claim 6 wherein said probe is cooled, said probe having a housing therearound forming an annular parrage to a cooling fluid, said cooling fluid being drawn through said housing by a flow through said vent conduit means.

9. A combination as set forth in claim 6 having a premixing tube connecting to said burner means, said premixing tube directing a flow of premixed fuel and air through said annular opening.

* * * * *

UNITED STATES PATENT OFFICE

CERTIFICATE OF CORRECTION

PATENT NO. : 4,051,670

DATED : October 4, 1977

INVENTOR(S) : ROBERT M. PIERCE

It is certified that error appears in the above-identified patent and that said Letters Patent are hereby corrected as shown below:

Column 3, line 53: after "reverse" insert -- gas --.

Claim 8, column 6, line 61: "parrage" should read -- passage --.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*